US006109762A

United States Patent [19]

Hallgrimsson et al.

[11] Patent Number: 6,109,762

[45] Date of Patent: Aug. 29, 2000

[54] PERIPHERALLY SEALED CARD-LIKE FLASHLIGHT DEVICE WITH PROTECTION AGAINST ACCIDENTAL SWITCH ACTUATION

[75] Inventors: Bjarki Hallgrimsson, Ottawa; Bryce Ashdown, Gloucester, both of Canada

[73] Assignee: Lumatec Industries, Inc., Austin, Tex.

[21] Appl. No.: 09/060,429

[22] Filed: Apr. 14, 1998

[51] Int. Cl.[7] ..... F21L 7/00

[52] U.S. Cl. ..... 362/200; 362/201

[58] Field of Search ..... 362/200, 201, 362/205

[56] References Cited

U.S. PATENT DOCUMENTS

| | | | |
|---|---|---|---|
| 5,158,356 | 10/1992 | Guthrie | 362/200 |
| 5,457,613 | 10/1995 | Vandenbelt | 362/201 |
| 5,893,631 | 4/1999 | Padden | 362/201 |
| 5,927,846 | 7/1999 | Sinclair | 362/201 |

FOREIGN PATENT DOCUMENTS

| | | | |
|---|---|---|---|
| 1443787 | 4/1966 | France | 362/200 |
| 403159001 | 7/1991 | Japan | 362/200 |

*Primary Examiner*—Sandra O'Shea
*Assistant Examiner*—Hargobind S. Sawhney
*Attorney, Agent, or Firm*—Flanagan & Flanagan; John K. Flanagan; John R. Flanagan

[57] ABSTRACT

A card-like flashlight device includes an inner light generating module having a housing, battery, lamp and switch member, and an outer protective cover. The housing has upper and lower surfaces and defines a central opening through the upper surface and a cavity below and in communication with the central opening. The battery is mounted in the cavity. The lamp has a bulb element and upper and lower conductive lead elements extending therefrom receiving the battery therebetween. The switch member is mounted in the central opening of the housing such that the switch member does not protrude beyond the upper surface of the housing and is deformable between a convex configuration in which the switch member does not deflect the upper conductive lead element into electrical contact with the battery and a concave configuration in which the dome switch member deflects the upper conductive lead element into electrical contact with the battery and thereby completes an electrical circuit between the lamp and battery for generating light. The outer protective cover has a flat sleeve-like configuration surrounding and hermetically sealing and encasing the inner light generating module. A middle folded card insert extends over and overlies the inner light generating module and is encased by the outer protective cover. An annular pad of insulative material is mounted over the battery such that only a central area of the battery is exposed for making electrical contact with the upper conductive lead element of the lamp.

20 Claims, 2 Drawing Sheets

PERIPHERALLY SEALED CARD-LIKE FLASHLIGHT DEVICE WITH PROTECTION AGAINST ACCIDENTAL SWITCH ACTUATION

BACKGROUND OF THE INVENTION

1. Field of the Invention

The present invention generally relates to portable lighting devices and, more particularly, is concerned with a peripherally sealed card-like flashlight device with protection against accidental switch actuation.

2. Description of the Prior Art

Miniature pocket flashlights which can be stored in a pocket or attached to a key chain are known in the prior art. An example of a miniature pocket flashlight is the one disclosed in U.S. Pat. Nos. 4,628,418 and 4,644,451 to Chabria. The Chabria miniature pocket flashlight has a hollow flexible outer case open at opposite ends, a pair of end caps closing the opposite ends of the outer case, a battery receptacle and electrical switch unit disposed in the case which is activated by squeezing the flexible case, and a lamp electrically connected and mounted to the unit and protruding through a hole in one of the end caps on the case (or alternatively the lamp is mounted to a socket in the end cap itself). At least the one end cap is removable in order to replace the lamp and batteries.

The design of the Chabria flashlight embodies at least three major drawbacks. First, the design permits light generated by the lamp to disperse in all possible radial directions from the lamp thus reducing the amount of light projected by the lamp on any one desired location. Second, the design requires that the lamp extend through a hole or from a socket in the end cap of the case. This design requirement leaves the lamp unprotected, exposing it to frequent impacts with extraneous objects while the flashlight is being handled and carried by the user. Such impacts are likely to soon cause breakage of the lamp filament and result in malfunction and premature shortening of the useful life of the lamp. Third, the design requires that one or both of the end caps of the case be frictionally fitted to the ends of the case so as to be readily removable to replace the lamp and batteries. Over time such frictional fit tend to loosen up and allow the parts of the flashlight to come apart. This increases the risk of losing an end cap which would then require the replacement of the flashlight itself.

A thin card-like flashlight device disclosed in U.S. Pat. No. 5,457,613 owned by Lumatec Industries, Inc. of Austin, Tex., and marketed under the trademark FLASHCARD, provides a functional and reliable design which overcomes the aforementioned drawbacks of the pocket flashlight design of the Chabria patents. The Lumatec flashlight device provides a package which is relatively thin and flat, has a card-like appearance and handles and feels similar to a credit card with which users are already familiar. The Lumatec flashlight device provides a highly fashionable item as well as providing the lighting function.

In order for the advantages and benefits of the Lumatec flashlight device to be enjoyed by a wider range of users, the inventor(s) herein have perceived a need for a peripherally sealed card-like flashlight device similar in concept to the prior art Lumatec flashlight device but improved so as to provide protection against accidental switch actuation and bulb breakage as well as to be attachable to a key chain or ring.

SUMMARY OF THE INVENTION

The present invention provides a peripherally sealed card-like flashlight device improved so as to satisfy the aforementioned needs. The peripherally sealed card-like flashlight device is similar in concept to the prior art Lumatec flashlight device but is particularly adapted to provide protection against accidental switch actuation and bulb breakage as well as to be attachable to a key chain or ring. The peripherally sealed card-like flashlight device employs a switch means which requires more effort on the part of a user to actuate and thereby illuminate a lamp of the device.

Accordingly, the present invention is directed to a flashlight device which comprises: (a) an inner light generating module including (i) a housing having an upper surface and a lower surface and defining a central opening through the upper surface and a cavity below and in communication with the central opening, (ii) a battery having opposite upper and lower faces and being mounted in the cavity of the housing such that the battery does not protrude beyond the upper surface of the housing, (iii) a lamp having a bulb element and a pair of upper and lower conductive lead elements extending therefrom and receiving the battery therebetween such that the upper and lower conductive lead elements are disposed respectively adjacent the upper and lower faces of the battery, and (iv) switch means mounted in the central opening of the housing between the upper surface thereof and the upper face of the battery such that the switch means does not protrude beyond the upper surface of the housing protecting the switch means from accidental actuation and such that depression of the switch means upon application of a predetermined pressure thereon causes the upper conductive lead element to make electrical contact with the upper face of the battery and thereby complete an electrical circuit between the lamp and battery for generating light; and (b) an outer protective cover having a generally flat sleeve-like configuration completely surrounding and hermetically sealing and encasing the inner light generating module therein. The device further comprises a middle folded card insert extending over and substantially overlying the inner light generating module and encased by the outer protective cover.

The housing of the inner light generating module has upper and lower portions. The upper portion defines the upper surface and central opening of the housing extending therethrough. The lower portion defines the lower surface of the housing and is attached to and in combination with the upper portion defines the cavity of the housing below and in communication with the central opening of the housing. The housing of the inner light generating module further defines a recess having generally angular-shaped opposite sides for exposing the bulb element of the lamp while protecting the bulb element from breakage. The upper surface of the housing defines a groove extending between the central opening and recess of the housing. The groove receives the upper conductive lead element of the lamp such that the upper conductive lead element extends into one of the central opening and cavity between the switch means and the upper face of the battery.

The outer protective cover is formed of a pair of generally flat planar sheets aligned with one another at and sealably connected to one another about continuous peripheral regions thereof. The outer protective cover is comprised of a substantially transparent flexible plastic material.

The device further comprises an annular pad of an electrically insulative material mounted on the upper face of the battery such that only a central area of the upper face of the battery is exposed for making electrical contact with the upper conductive lead element of the lamp. The switch means is disposed over the central area of the upper face of the battery exposed within the annular pad such that deflection of the switch means will cause the upper conductive lead element of the lamp to electrically contact the central area of the upper face of the battery upon application of the predetermined pressure to the switch means through the outer protective cover.

The switch means of the inner light generating module preferably is a dome-shaped switch member deformable between a substantially convex configuration in which the dome switch member does not deflect the upper conductive lead element of the lamp into electrical contact with the battery and a substantially concave configuration in which the dome-shaped switch member deflects the upper conductive lead element of the lamp into electrical contact with the battery. The dome-shaped switch member is biased to return to the convex configuration upon release of application of the predetermined pressure thereon and will move to the concave configuration upon application of the predetermined pressure thereon.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
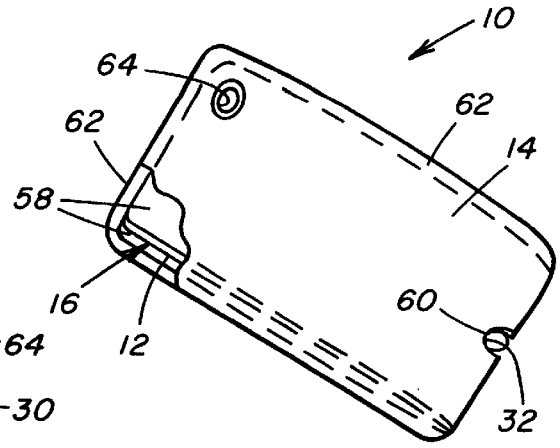
FIG. 1 is a perspective view of a flat card-like flashlight device of the present invention with portions broken away to show an outer protective cover enclosing an inner light generating module and a middle card insert making up the device.
Figure 2:
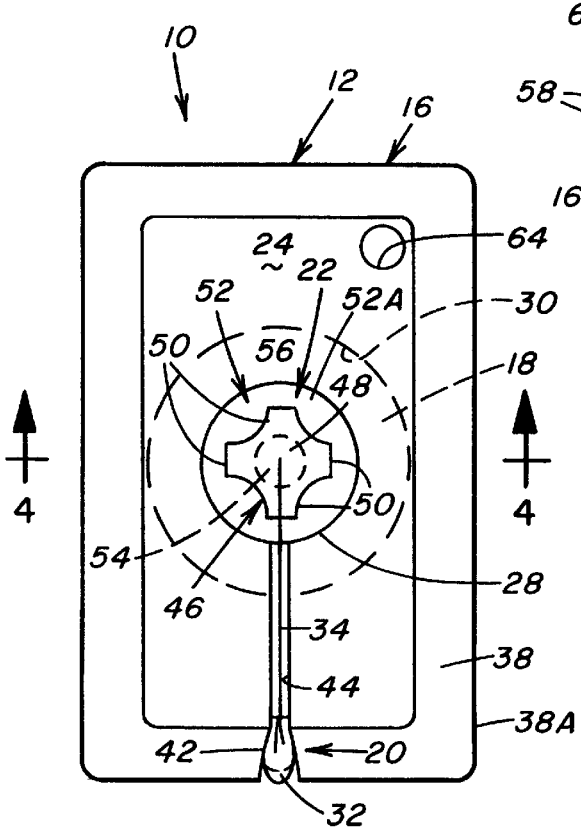
FIG. 2 is an enlarged top plan view of the inner light generating module of the device of FIG. 1.
Figure 3:
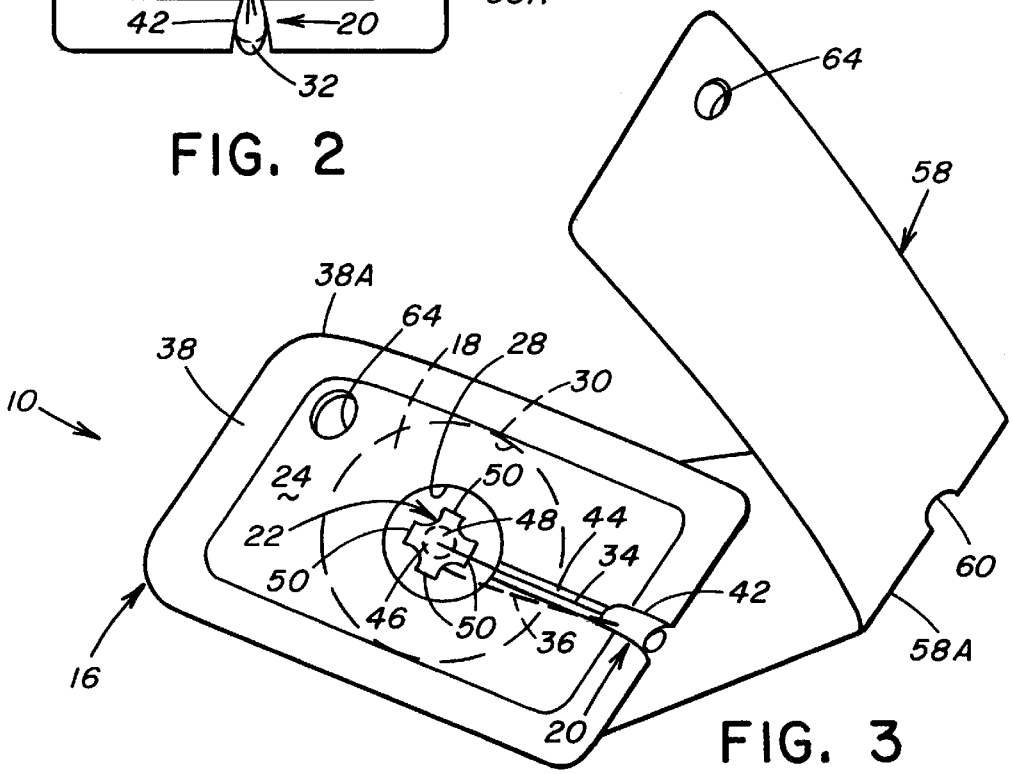
FIG. 3 is an enlarged perspective exploded view of the middle card insert and light generating module of the device.

Referring to the drawings and particularly to FIGS. 1 to 3, there is illustrated a flashlight device, generally designated 10, having features in accordance with the principles of the present invention. Basically, the flashlight device 10 includes an inner light generating module 12 and an outer protective cover 14. The inner light generating module 12 includes a housing 16, a battery 18, a lamp 20 and switch means 22. The housing 16 has an upper surface 24 and a lower surface 26 and defines a central opening 28 through the upper surface 24 and a cavity 30 below and in communication with the central opening 28. The battery 18 having opposite upper and lower faces 18A, 18B is mounted in the cavity 30 of the housing 16 such that the battery 18 does not protrude above or beyond the upper surface 24 of the housing 16 nor substantially below or beyond the lower surface 26 of the housing 16. The cavity 30 is open at the lower surface 26 of the housing 16 althought it could be closed. The lamp 20 has a bulb element 32 and a pair of upper and lower conductive lead elements 34, 36 extending therefrom and receiving the battery 18 therebetween such that the upper and lower conductive lead elements 34, 36 are disposed respectively adjacent the upper and lower faces 18A, 18B of the battery 18. The switch means 22 is mounted in the central opening 28 of the housing 16 such that the switch means 22 does not protrude above or beyond the upper surface 24 of the housing 16 protecting the switch means 22 from accidental actuation and such that depression of the switch means 22 toward the battery upon application of a predetermined pressure thereon causes the upper conductive lead element 24 to make electrical contact with the upper face 18A of the battery 18 and thereby complete an electrical circuit between the lamp 20 and battery 18 for generating light. The lower conductive lead element 24 extends below the lower face 18B of the battery 18 and preferably is attached thereto so as to always be in electrical contact therewith. The outer protective cover 14 has a generally flat sleeve-like configuration completely surrounding and hermetically sealing and encasing the inner light generating module 12 therein.

Referring now to FIGS. 4 to 10, the housing 16 of the inner light generating module 12 has upper and lower portions 38, 40 which individually and together are substantially flat and have a card-like appearance. The upper portion 38 has a substantially continuous peripheral edge 38A defining a pair of opposite parallel sides, a pair of opposite parallel ends and four rounded corners interconnecting adjacent ones of the sides and ends. The upper portion 38 defines the upper surface 24 and central opening 28 of the housing 16. The upper surface 24 is substantially flat or planar except for an annular border or perimeter portion which tapers or slopes downwardly and outwardly to the peripheral edge 38A.

Figure 4:
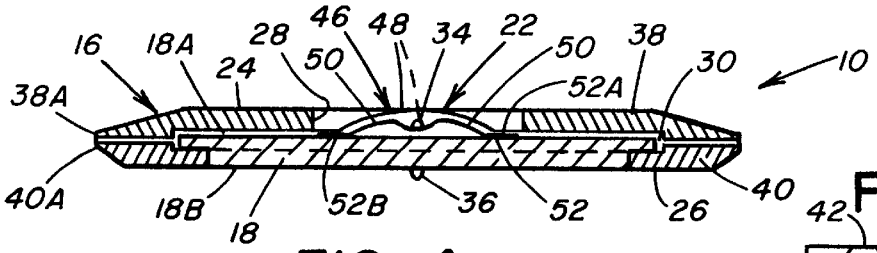
FIG. 4 is an enlarged transverse sectional view of the inner light generating module taken along line 4—4 of FIG. 2.
Figure 5A:
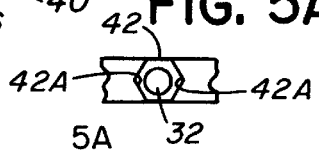
FIG. 5A is a fragmentary front end of a recess having angular-shaped opposite sides for exposing a bulb element of the lamp but providing protection of the bulb element against contact that would result in breakage.
Figure 8:
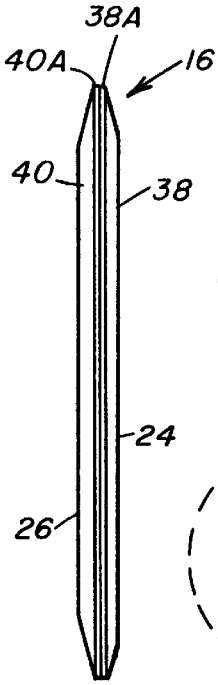
FIG. 8 is a side elevational view of the housing as seen along line 8—8 of FIG. 5.
Figure 9:
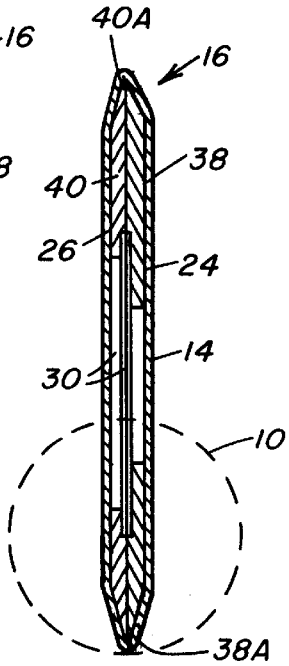
FIG. 9 is a longitudinal sectional view of the housing taken along line 9—9 of FIG. 5.
Figure 5:
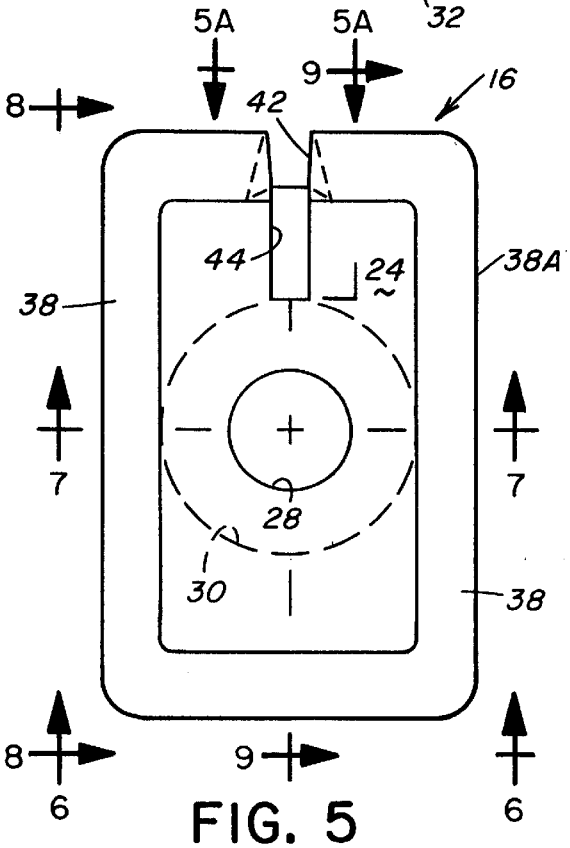
FIG. 5 is a top plan view of a housing of the inner light generating module with a lamp and battery omitted.
Figure 10:
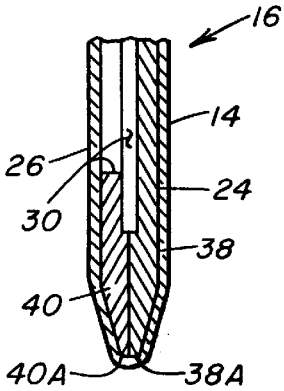
FIG. 10 is an enlarged detailed view of the portion of the housing encompassed by circle 10 of FIG. 9.
Figure 7:
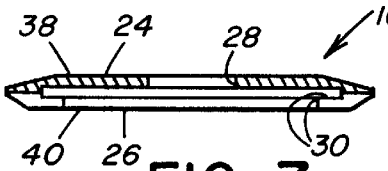
FIG. 7 is a transverse sectional view of the housing taken along line 7—7 of FIG. 5.
Figure 6:
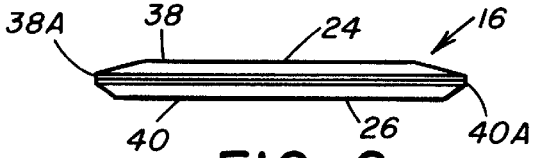
FIG. 6 is a rear view of the housing as seen along line 6—6 of FIG. 5.

The lower portion 40 of the housing 16 likewise has a substantially continuous peripheral edge 40A defining a pair of opposite parallel sides, a pair of opposite parallel ends and four rounded corners interconnecting adjacent ones of the sides and ends. The lower portion 40 defines the lower surface 26 of the housing 16. As in the case of the upper surface 24, the lower surface 26 is substantially flat or planar except for an annular border or perimeter portion which tapers or slopes upwardly and outwardly to the peripheral edge 40A. The lower portion 40 is attached using any suitable technique, such as welding or gluing, to the upper portion 38 in a sandwich-like fashion and in combination with the upper portion 38 defines the cavity 30 of the housing 12 below and in communication with the central opening 28 of the housing 16. As mentioned above, the cavity 30 may be either open, as seen in FIGS. 4, 7 and 9, or closed at the lower surface 26.

The housing 16 also defines a recess 42 exposing the bulb element 32 of the lamp 20. The recess 42 which has angular-shaped, such as V-shaped, opposite sides 42A for capturing and protecting the bulb element 32 from breakage, is of a size just large enough to fit the bulb element 32 therewithin. The recess 42 is particularly centrally defined at one end of the housing 16 formed the upper and lower portions 38, 40.

The upper surface 24 of the housing 16 further defines an elongated groove 44. The groove 44 extends between the end recess 42 and the central opening 28 of the upper surface 24 of the housing 16. The groove 44 receives the upper conductive lead element 34 of the lamp 20 such that the upper conductive lead element 34 extends into the central opening 28 between the switch means 22 and the upper face 18A of the battery 18. The groove 44 only needs to be of a size large enough to fit the upper conductive lead elements 34 therewithin. The lower conductive lead element 36 merely extends between the recess 42 along the lower surface 26 of the housing 16 to the lower face 18B of the battery 18 exposed at the cavity 20. If desired, a groove could be provided in the lower surface 26 of the housing 16 between the recess 42 and cavity 30 to accommodate the lower conductive lead element 36. The end of the lower conductive lead element 36 is preferably fixedly attached to the lower face 18B of the battery 18 so as to always be in electrical contact therewith. The central opening 28 is generally circular in shape, though it may have any other suitable configuration. The central opening 28 is of a size just large enough to receive a switch means 22 therewithin. The cavity 30 is generally circular in shape, though it may have any other suitable configuration, and is of a size larger than the central opening 28 and just large enough to receive a battery 18 therewithin.

The battery 18 of the inner light generating module 12 has a substantially disc-like shape, though may have any other suitable configuration, and is of any suitable size. The battery 18 is mounted substantially inside the cavity 30 of the housing 16 with its peripheral edge captured between interior edges of the upper and lower portions 38. 40 of the housing 16 defining the cavity 30. As mentioned above, the lower conductive lead element 36 of the lamp 20 is preferably permanently connected to the battery 18 by any suitable means, whereas the upper conductive lead element 34 does not electrically contact the battery 18 until the switch means 22 is actuated (depressed). The battery 18 and lamp 20 may be of any conventional types.

Referring to FIGS. 2 to 4, the switch means 22 of the inner light generating module 12 preferably is a dome-shaped switch member 46. The dome-shaped switch member 46 has a center portion 48 and a plurality of legs 50 spaced apart from one another and extending radially outwardly from the center portion 48. The center portion 48 is substantially circular in shape. Each leg 50 is partially rectangular in shape and substantially smaller than the center portion 48, though may have any suitable configuration and size. The legs 50 preferably number four. The dome-shaped switch member 46, upon application of a predetermined finger pressure, is deformable from a substantially convex configuration in which it does not deflect the upper conductive lead element 34 of the lamp 20 into electrical contact with the upper face 18A of the battery 18, to a substantially concave configuration in which the dome-shaped switch member 46 deflects the upper conductive lead element 34 into electrical contact with the upper face 18A of the battery 18. The dome-shaped switch member 46 is biased to return to the substantially convex configuration upon release of application of the predetermined pressure thereon and will move to the substantially concave configuration upon application of the predetermined pressure thereon. The center portion 48 is the only part of the dome-shaped switch member 46 which is deformable between the substantially concave and convex configurations.

The device 10 further comprises a thin annular pad 52 of electrically insulative material. The annular pad 52 is mounted on the upper face 18A of the battery 18 such that only a central circular area 54 of the upper face 18A of the battery is exposed through a central hole 56 of the pad 52 for making electrical contact with the upper conductive lead element 34 of the lamp 20. The pad 52 is a thin annular body preferably of a suitable electrically non-conductive material having the central hole 56 defined therethrough and having a pair of opposite faces 52A, 52B. The legs 50 of the dome-shaped switch member 46 contact and rest on the outer face 52A of the pad 52 such that the center portion 48 of the dome-shaped switch member 46 is disposed over and spaced above the central circular area 54 of the battery 18 for making electrical contact therewith when the central portion 48 of the dome-shaped switch member 46 is depressed into the substantially concave configuration. The opposite inner face 52B of the pad 52 is coated with a suitable adhesive for affixing the pad 52 onto the upper face 18A of the battery 18. The upper conductive lead element 34 of the lamp 20 extends either over the central portion 48 or between a pair of the legs 50 of the dome-shaped switch member 46 to above the central circular area 54 of the battery 18.

Referring to FIGS. 1 and 2, the device 10 further comprises a middle folded card insert 58 extending over and substantially overlying the inner light generating module 12. The middle folded card insert 58 is a generally flat sheet of flexible paper or plastic material folded in half about a middle transverse fold line 58A which, in the folded condition, can extend over and substantially overlie and cover the opposite upper and lower surfaces 24, 26 of the housing 16 of the inner light generating module 12. Also, the middle folded card insert 58 has an opening 60, preferably of oblong shape, formed therein along the middle fold line 58A so as to define an aperture aligned with the bulb element 32 of the lamp 20 of the inner light generating module 12. One or both exterior faces of the middle folded card insert 58 can be imprinted with a media displaying information to a user of the device 10. Also, the opening 60 can be reinforced by application of a creased strip of plastic film, such as mylar, which is bonded to an inside surface of the middle folded card insert 58 about the opening 60.

The outer protective cover 14 is formed of a pair of flat planar sheets 62 and is comprised of a substantially transparent flexible plastic material. The flat planar sheets 62 are aligned with one another at and sealably connected to one another about the continuous peripheral regions thereof. The aligned and sealed flat planar sheets 62 provide the outer protective cover 14 with the generally flat sleeve-like configuration which completely surrounds and hermetically seals and encases the inner light generating module 12 and folded card insert 58 therein.

Lastly, as seen in FIGS. 1 to 3, the device 10 may also be used with a key ring or the like. The housing 16 of the inner light generating module 12, outer protective cover 14 and middle folded card insert 58 together define a composite hole 64 therethrough, as shown in FIGS. 1 to 3. The hole 64 is for receiving the key ring through the device 10. The hole 64 is disposed closer to an end of the device 10 opposite from the bulb element 32 of the lamp 20 and toward a corner thereof, though may be in any other suitable location.

It is thought that the present invention and many of its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

What is claimed is:

1. A flashlight device, comprising:

(a) an inner light generating module including (i) a housing having an upper surface and a lower surface and defining a central opening through said upper surface and a cavity below and in communication with said central opening, (ii) a battery having opposite upper and lower faces and being mounted in said cavity of said housing such that said battery does not protrude beyond said upper surface of said housing, (iii) a lamp having a bulb element and a pair of upper and lower conductive lead elements extending therefrom and receiving said battery therebetween such that said upper and lower conductive lead elements are disposed respectively adjacent said upper and lower faces of said battery, and (iv) switch means mounted in said central opening of said housing between said upper surface thereof and said upper face of said battery such that said switch means does not protrude beyond said upper surface of said housing protecting said switch means from accidental actuation and such that depression of said switch means toward the battery upon application of a predetermined pressure thereon causes said upper conductive lead element to make electrical contact with said battery and thereby complete an electrical circuit between said lamp and battery for generating light; and (b) an outer protective cover having a generally flat sleeve-like configuration completely surrounding and hermetically sealing and encasing said inner light generating module therein.

2. The device of claim 1 wherein said housing has upper and lower portions, said upper portion defining said upper surface and central opening of said housing extending therethrough, said lower portion defining said lower surface of said housing and being attached to and in combination with said upper portion defining said cavity of said housing below and in communication with said central opening of said housing.

3. The device of claim 1 wherein said housing further defines a recess having generally angular-shaped opposite sides for exposing said bulb element of said lamp while providing protection of said bulb from breakage.

4. The device of claim 3 wherein said upper surface of said housing defines a groove extending between said central opening and said recess of said housing and receiving said upper conductive lead element of said lamp such that said upper conductive lead element extends into one of said cavity and central opening between said switch means and said upper face of said battery.

5. The device of claim 1 wherein said outer protective cover is formed of a pair of generally flat planar sheets aligned with one another at and sealably connected to one another about continuous peripheral regions thereof.

6. The device of claim 1 wherein said outer protective cover is comprised of a substantially transparent flexible plastic material.

7. The device of claim 1 further comprising:

a middle folded card insert extending over and substantially overlying said inner light generating module and encased by said outer protective cover.

8. A flashlight device, comprising:

(a) an inner light generating module including (i) a housing having an upper surface and a lower surface and defining a central opening through said upper surface and a cavity below and in communication with said central opening, (ii) a battery having opposite upper and lower faces and being mounted in said cavity of said housing such that said battery does not protrude beyond said upper surface of said housing, (iii) a lamp having a bulb element and a pair of upper and lower conductive lead elements extending therefrom and receiving said battery therebetween such that said upper and lower conductive lead elements are disposed respectively adjacent said upper and lower faces of said battery, and (iv) switch means mounted in said central opening of said housing between said upper surface thereof and said upper face of said battery such that said switch means does not protrude beyond said upper surface of said housing protecting said switch means from accidental actuation and such that depression of said switch means toward the battery upon application of a predetermined pressure thereon causes said upper conductive lead element to make electrical contact with said battery and thereby complete an electrical circuit between said lamp and battery for generating light;

(b) an annular pad of electrically insulative material mounted on said upper face of said battery such that only a central area of said upper face of said battery is exposed for making electrical contact with said upper conductive lead element of said lamp; and (c) an outer protective cover having a generally flat sleeve-like configuration completely surrounding and hermetically sealing and encasing said inner light generating module therein.

9. The device of claim 8 wherein said switch means is disposed over said central area of said battery exposed within said annular pad such that deflection of said switch means will cause said upper conductive lead element of said lamp to electrically contact said central area of said upper face of said battery upon application of the predetermined pressure to said switch means through said outer protective cover.

10. The device of claim 9 wherein said switch means includes a dome-shaped switch member deformable between a substantially convex configuration in which said dome-shaped switch member does not deflect said upper conductive lead element of said lamp into electrical contact with said battery and a substantially concave configuration in which said dome-shaped switch member deflects said upper conductive lead element of said lamp into electrical contact with said battery, said dome-shaped switch member being biased to return to said convex configuration upon release of application of the predetermined pressure thereon and will move to said concave configuration upon application of the predetermined pressure thereon.

11. The device of claim 8 wherein said housing has upper and lower portions, said upper portion defining said upper surface and central opening of said housing extending therethrough, said lower portion defining said lower surface of said housing and being attached to and in combination with said upper portion defining said cavity of said housing below and in communication with said central opening of said housing.

12. The device of claim 8 wherein said housing further defines a recess having generally angular-shaped opposite sides for exposing said bulb element of said lamp while providing protection of said bulb from breakage.

13. The device of claim 12 wherein said upper surface of said housing defines a groove extending between said central opening and said recess of said housing and receiving said upper conductive lead element of said lamp such that said upper conductive lead element extends into one of said cavity and central opening between said switch means and said upper face of said battery.

14. The device of claim 8 wherein said outer protective cover is formed of a pair of flat planar sheets aligned with one another at and sealably connected to one another about continuous peripheral regions thereof.

15. The device of claim 14 wherein said outer protective cover is comprised of a substantially transparent flexible plastic material.

16. The device of claim 8 further comprising:

a middle folded card insert extending over and substantially overlying said inner light generating module and encased by said outer protective cover.

17. A flashlight device, comprising:

(a) an inner light generating module including (i) a housing having an upper surface and a lower surface and defining a central opening therethrough and a cavity below and in communication with said central opening, (ii) a battery mounted in said cavity of said housing, (iii) a lamp having a light element and a pair of upper and lower conductive lead elements extending therefrom and receiving said battery therebetween, and (iv) a dome-shaped switch member mounted in said central opening of said housing such that said switch member does not protrude beyond said upper surface of said housing protecting said switch member from accidental actuation and such that depression of said switch member toward the battery upon application of a predetermined pressure thereon causes said upper conductive lead element to make electrical contact with said battery and thereby complete an electrical circuit between said lamp and battery for generating a light, said dome-shaped switch member being deformable between a substantially convex configuration in which said dome-shaped switch member does not deflect said upper conductive lead element of said lamp into electrical contact with said battery and a substantially concave configuration in which said dome-shaped switch member deflects said upper conductive lead element of said lamp into electrical contact with said battery, said dome-shaped switch member being biased to return to said convex configuration upon release of application of the predetermined pressure thereon and will move to said concave configuration upon application of the predetermined pressure thereon; and (b) an outer protective cover having a generally flat sleeve-like configuration completely surrounding and hermetically sealing and encasing said inner light generating module therein.

18. The device of claim 17 wherein said housing has upper and lower portions, said upper portion defining said upper surface and central opening of said housing therethrough and said lower portion defining said lower surface of said housing and being attached to and in combination with said upper portion defining said cavity of said housing below and in communication with said central opening of said housing.

19. The device of claim 17 wherein:

said housing defines a recess with generally V-shaped opposite sides exposing said bulb element of said lamp while providing protection of said bulb from breakage; and said upper surface of said housing defines a groove extending between said central opening and said recess of said housing and receiving said upper conductive lead element of said lamp such that said upper conductive lead element extends into one of said cavity and central opening between said dome-shaped switch member and said upper face of said battery.

20. The device of claim 17 further comprising:

a middle folded card insert extending over and substantially overlying said inner light generating module and encased by said outer protective cover.

* * * * *